United States Patent [19]

Yoshikawa

[11] Patent Number: 4,548,489

[45] Date of Patent: Oct. 22, 1985

[54] DEVICE FOR FORMING A THIN LAYER OF DEVELOPER

[75] Inventor: Masao Yoshikawa, Tokyo, Japan

[73] Assignee: Canon Kabushiki Kaisha, Tokyo, Japan

[21] Appl. No.: 466,574

[22] Filed: Feb. 15, 1983

[30] Foreign Application Priority Data

Feb. 19, 1982 [JP] Japan ..... 57-25676

[51] Int. Cl.[4] ..... G03G 15/09

[52] U.S. Cl. ..... 355/3 DD; 118/657; 118/658

[58] Field of Search ..... 355/3 R, 3 DD; 118/656, 118/657, 658, 661

[56] References Cited

U.S. PATENT DOCUMENTS

| | | | |
|---|---|---|---|
| 4,244,322 | 1/1981 | Nomura et al. | 118/657 X |
| 4,292,387 | 9/1981 | Kanbe et al. | 430/102 |
| 4,331,757 | 5/1982 | Tanaka et al. | 355/3 DD X |
| 4,386,577 | 6/1983 | Hosono et al. | 355/3 DD X |
| 4,391,512 | 7/1983 | Nakamura et al. | 355/3 DD |

*Primary Examiner*—Fred L. Braun

*Attorney, Agent, or Firm*—Fitzpatrick, Cella, Harper & Scinto

[57] ABSTRACT

A device and method for forming a thin layer of one-component non-magnetic developer on the surface of a developer carrying member in a dry type developing device using one-component non-magnetic developer. The non-magnetic developer is supplied to the surface of the developer carrying member, a magnetic blade is disposed with a clearance to the surface of the developer carrying member, and a stationary magnet is disposed across the developer carrying member from the magnetic blade and upstream of the magnetic blade with respect to the direction of movement of the developer carrying member to confine the magnetic particles is formed between the magnet and the magnetic blade. The developer carrying member with the developer is moved past the confined magnetic particles to form a thin layer of dry one-component non-magnetic developer on the surface of the developer carrying member.

3 Claims, 1 Drawing Figure

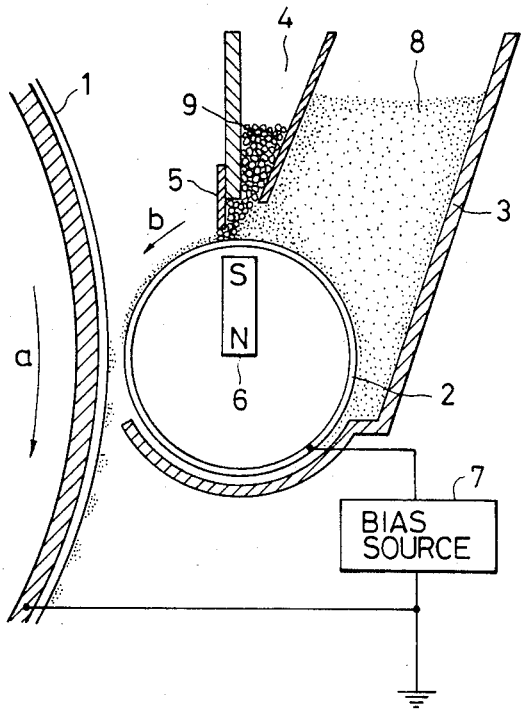
4
8
1
9
5
3
b
S
N
a
6
2
7
BIAS
SOURCE

DEVICE FOR FORMING A THIN LAYER OF DEVELOPER

BACKGROUND OF THE INVENTION

1. Field of the Invention

This invention relates to a device for forming a thin layer of dry one-component developer. Further, it relates to a device for forming a thin layer of non-magnetic developer.

2. Description of the Prior Art

Various dry type one-component developing devices have heretofore been proposed and put into practical use. However, in any of these developing systems, it has been very difficult to form a thin layer of dry one-component developer and therefore, the developing devices have been constructed for the formation of a relatively thick layer. Now that improvement of the sharpness, resolving power, etc. of the developed image is required, development of a method and device for forming a thin layer of dry one-component developer is requisite.

The heretofore known method of forming a thin layer of dry one-component developer is proposed in U.S. Pat. No. 4,292,387 and has been put into practical use. This has been concerned with the formation of a thin layer of magnetic developer. Magnetic developer requires a magnetic material to be added thereto to endow it with magnetism, and this leads to problems such as the poor fixativeness with which a developed image transferred to transfer paper is heat-fixed, the bad color during color reproduction which results from the addition of the magnetic material to the developer itself (the magnetic material is usually black), etc.

For this reason, as a method of forming a thin layer of non-magnetic developer, there has been proposed a method comprising making soft hair like beaver's hair into a cylindrical brush and applying developer to such brush or a method comprising applying developer to a developing roller having the surface thereof formed of fiber such as velvet by means of a doctor blade or the like.

However, where an elastic blade as the doctor blade is used with the fiber brush, control of the amount of developer is possible but uniform application of the developer cannot be achieved and frictional charging of developer particles present between the fibers of the brush is not effected with the blade merely frictionally contacting the fiber brush on the developing roller, and this has led to the problem that ghost or the like is liable to occur.

SUMMARY OF THE INVENTION

It is an object of the present invention to provide a device for forming a thin layer of dry one-component developer on the surface of a developer carrying member.

It is another object of the present invention to provide a device for forming a thin layer of non-magnetic one-component developer on the surface of a developer carrying member.

It is still another object of the present invention to provide a device for forming a thin layer of one-component developer of good fixation performance on the surface of a developer carrying member.

It is yet still another object of the present invention to provide a device for forming a thin layer of one component developer of good color reproducibility on the surface of a developer carrying member.

It is a further object of the present invention to provide a device in which non-magnetic developer is supplied to the surface of a developer carrying member carrying non-magnetic developer thereon, a magnetic blade is disposed to the surface of the developer carrying member with a clearance therebetween, a magnet is disposed on a side of the developer carrying member remote from the magnetic blade and upstream of the magnetic blade with respect to the direction of movement of the developer carrying member, and a magnetic brush of magnetic particles is formed between the magnet and the magnetic blade, whereby a thin layer of dry one-component developer is formed on the surface of the developer carrying member.

The invention will become fully apparent from the following detailed description thereof taken in conjunction with the accompanying drawing.

BRIEF DESCRIPTION OF THE DRAWING

The FIGURE illustrates a device for forming a thin layer of non-magnetic developer according to the present invention.

DESCRIPTION OF THE PREFERRED EMBODIMENTS

The device for forming a thin layer of developer according to the present invention comprises a developer carrying member carrying non-magnetic developer thereon, developer supply means for supplying the non-magnetic developer to the surface of the developer carrying member, a magnetic blade disposed to the surface of the developer carrying member with a clearance therebetween, a magnet disposed on a side of the developer carrying member remote from the magnetic blade and upstream of the magnetic blade with respect to the direction of movement of the developer carrying member, and a magnetic brush of magnetic particles formed between the magnet and the magnetic blade.

In the thin developer layer forming device of such construction, when the non-magnetic developer is supplied to a developer supply container, magnetic particles and the non-magnetic developer are stirred and mixed together by rotation of the cylindrical developer carrying member and are further circulated and rotated upstream thereof by the blocking by the magnetic blade. Thus, the non-magnetic developer is frictionally charged by the mixing thereof with the magnetic particles. The frictionally charged non-magnetic developer is uniformly thinly applied to the surface of the cylindrical developer carrying member from a magnetic brush portion formed on the magnetic blade, by reflection force.

In the normal state, if there is the non-magnetic developer in the magnetic brush portion, the proportion of the non-magnetic developer to the magnetic particles in the magnetic brush portion is substantially at a constant value and even when the applied non-magnetic developer is used and consumed for development by known means, the non-magnetic developer is automatically supplied to the magnetic brush portion and therefore, a predetermined amount of coating is always possible.

An embodiment of the present invention will hereinafter be described in detail.

Referring to the FIGURE, a cylindrical electrophotographic photosensitive medium 1 is movable in the direction of arrow a. A cylindrical developer carrying member 2 carrying developer thereon disposed with a clearance with respect to the photosensitive medium is rotatively moved in the direction of arrow b. A developer supply container 3 is provided to supply the developer to the developer carrying member. A magnetic particle supply container 4 is provided downstream of the developer supply container with respect to the direction of rotation of the cylindrical developer carrying member 2. At the entrance side of the developer container, a surrounding member is formed so as to surround the lower portion of the cylindrical developer carrying member and prevent leakage of the developer. A magnetic blade 5 formed of a magnetic material is disposed at the exit of the developer supply container 3. A magnet 6 is provided within the developer carrying member on that side thereof opposite the magnetic blade. The location of this magnet is upstream of the opposed magnetic blade 5 with respect to the direction of rotation of the cylindrical developer carrying member 2.

In the developing device of such construction, by magnetic particles 9 and non-magnetic developer 8 being supplied to the developer supply container, a brush of magnetic particles is formed between the magnetic blade and the surface of the cylindrical developer carrying member to which the magnet is opposed. The magnetic particles and the non-magnetic developer are stirred and mixed together by rotation of the cylindrical developer carrying member and are further circulated and rotated upstream of the magnetic blade by the blocking by the magnetic blade. Thus, the non-magnetic developer is frictionally charged by the mixing thereof with the magnetic particles. The frictionally charged non-magnetic developer is uniformly thinly applied to the surface of the cylindrical developer carrying member from the magnetic brush portion formed on the magnetic blade portion, by reflection force. In the normal state, if there is the non-magnetic developer in the magnetic brush portion, the proportion of the non-magnetic developer to the magnetic particles in the magnetic brush portion is substantially at a constant value and even when the applied non-magnetic developer is used and consumed for development by known means, the non-magnetic developer is automatically supplied to the magnetic brush portion and therefore, a predetermined amount of coating is always possible.

First Example:

A first example of the present invention will hereinafter be described by reference to the Figure.

In the FIGURE, the cylindrical electrophotographic photosensitive medium 1 is rotatively moved in the direction of arrow a. The surface of the developer carrying member 2 is a rough surface. Non-magnetic developer 8 having ethylene vinyl acetate copolymer resin as a component is contained in the developer supply container 3. Magnetic particles are supplied into the magnetic particle supply container 4. The blade 5 as a magnetic member or a magnet member forms a magnetic field between it and the magnet 6. A brush of magnetic particles is formed along this magnetic field. This brush controls the passage of the non-magnetic developer 8 in the magnetic particle supply container 3 and controls it to a desired thickness. The non-magnetic developer is charged chiefly by the friction thereof with the magnetic particles 9 and is applied onto the cylindrical developer carrying member 2 due to the electrostatic force between it and the cylindrical developer carrying member 2. Designated by 7 is a bias voltage source for applying a voltage between the electrophotographic photosensitive medium 1 and the developer carrying member. This voltage source may be either DC or AC, and may also be DC superposed on AC. Development should preferably be effected in accordance with the description made in U.S. Pat. No. 4,292,387. In the above-described construction, the clearance between the magnetic blade 5 and the developer carrying member 2 is set to the order of 250 μm. The magnetic particles 9 are restrained by the magnetic field between the magnetic blade 5 and the developer carrying member 2 and form a brush. When the developer carrying member 2 is rotated in the follow-up direction at a peripheral speed substantially equal to the peripheral speed of the electrophotographic photosensitive medium, the non-magnetic developer 8 is moved while being dragged by the developer carrying member 2 having the rough surface and at the same time, it is sufficiently charged by the friction between the magnetic particles 9 and the surface of the developer carrying member and adheres to the magnetic particles and the developer carrying member due to electrostatic force, but since the magnetic particles 9 cannot move due to the restraint of said magnetic field, only the non-magnetic developer having adhered to the surface of the developer carrying member 2 can pass through the brush of magnetic particles and, by rotation of the developer carrying member 2, a uniformly thin coating layer of non-magnetic developer 8 is created on the developer carrying member 2.

As described above, the non-magnetic developer 8 is applied onto the developer carrying member 2 while passing through the magnetic particles 9 and therefore, the non-uniform non-magnetic developer layer created by the image portion and non-image portion of the original during the previous cycle of development is uniformized and uniformly applied to the developer carrying member, so that it never happens that the next cycle of development is effected with the ghost of the pattern of the previous original remaining on the developer carrying member.

According to the present invention, as described above, a uniform thin layer of non-magnetic developer can be applied onto the developer carrying member and such application of the layer can be accomplished without being affected by the pattern of the previous original. Also, charging of the non-magnetic developer is effected sufficiently and therefore, a sharp image of good harmony can be obtained.

Thereafter, when only the non-magnetic developer was further supplied in accordance with the consumption of the developer and the cylindrical developer carrying member was rotated, there was obtained a good uniform coating of non-magnetic developer on the cylindrical developer carrying member.

Also, by mixing part of the non-magnetic developer with the magnetic particles in advance as previously described, a stable coating can be obtained from the initial stage. If the non-magnetic developer is not mixed with the magnetic particles in advance but only the magnetic particles are supplied at first and then the non-magnetic developer is supplied, irregularity of the thickness of the coating is liable to occur until the non-magnetic developer and the magnetic particles are sufficiently mixed. Also, it was difficult to restrain only the magnetic particles in the magnetic blade portion and complete restraint of the magnetic particles was possible only in the presence of the non-magnetic developer.

This would be attributable to the fact that the non-magnetic developer having adhered to the magnetic particles decreases the friction between the cylindrical developer carrying member and the magnetic particles.

An example in which the surface potential of the non-magnetic developer layer applied onto the developer carrying member 2 is satisfied will now be shown. Stainless steel (SUS 304) was used as the material of the developer carrying member 2, and iron particles larger than the particle diameter of the non-magnetic developer 8 were used as the magnetic particles 9. The following two materials were prepared as the non-magnetic developer 8 and formation of a thin layer of non-magnetic developer 8 was carried out:

(1) A material made by melting and blending 100 parts of styrene, acryl and maleic acid resin and 7 parts of carbon black and grinding the mixture; and (2) A material made by melting and blending 100 parts of styrene and acryl, 7 parts of carbon black and 2 parts of nigrosine and grinding the mixture.

(I) When the non-magnetic developer mentioned under item (1) above was used, the surface potential of the layer of non-magnetic developer 8 applied onto the developer carrying member 2 was about −30 V relative to the member 2.

(II) When the non-magnetic developer mentioned under item (2) above was used, the surface potential of the layer of non-magnetic developer 8 applied onto the developer carrying member 2 was about +25 V relative to the member 2.

When the development was carried out with the following developing bias by the use of NP200 J copying apparatus, it was found that sharp regular development could be obtained in case (I) and sharp inverted development could be obtained in case (II).

To use the thus obtained coating layer of non-magnetic developer for the developing action, a voltage of frequency 800 Hz, peak-to-peak value 1.8 KV and center value +100 V was applied by a voltage source E to between an electrophotographic photosensitive medium having a dark portion +500 V and a light portion −50 v as an electrostatic latent image and the cylindrical developer carrying member with a spacing of 300 μm between the surface of the electrophotographic photosensitive medium and the surface of the cylindrical developer carrying member, whereby a good sharp image free of ghost and fog was obtained by the use of NP200 J copying apparatus produced by Canon Inc.

Further, no fluctuation of image density occurred until the non-magnetic developer was almost consumed.

I claim:

1. A device for forming a layer of non-magnetic developer particles on a surface of a developer carrying member comprising:

means for providing magnetic particles and non-magnetic developer particles onto the developer carrying member;

a magnetic blade disposed with a clearance to the developer carrying member;

a magnet stationarily disposed across the developer carrying member from said magnetic blade to form a magnetic field between said magnetic blade and said magnet to confine the magnetic particles; and means for moving the developer carrying member to carry the non-magnetic developer particles thereon and pass them by a region of the confined magnetic particles to form a thin layer of the non-magnetic developer particles on the developer carrying member.

2. A device according to claim 1, wherein said developer carrying member has a rough surface.

3. A device according to claim 1, wherein said magnetic blade is a magnet.

* * * * *